US009876302B2

(12) United States Patent
Volkmer et al.

(10) Patent No.: US 9,876,302 B2
(45) Date of Patent: Jan. 23, 2018

(54) MEDICAL INSTRUMENT AND DRIVE UNIT EACH HAVING AN INTERFACE FOR ELECTRICALLY CONNECTING THE DRIVE UNIT WITH THE MEDICAL INSTRUMENT

(71) Applicant: KARL STORZ GMBH & CO. KG, Tuttlingen (DE)

(72) Inventors: Dominik Volkmer, Fridingen (DE); Jochen Stefan, Wald (DE); Markus Simmen, Zürich (CH); Martina Rogg, Eggingen (DE); Patrick Buchbauer, Volkershausen (DE)

(73) Assignee: KARL STORZ GMBH & CO. KG, Tuttlingen (DE)

( * ) Notice: Subject to any disclaimer, the term of this patent is extended or adjusted under 35 U.S.C. 154(b) by 0 days.

(21) Appl. No.: 15/207,404

(22) Filed: Jul. 11, 2016

(65) Prior Publication Data

US 2017/0018869 A1 Jan. 19, 2017

(30) Foreign Application Priority Data

Jul. 17, 2015 (DE) ..... 10 2015 111 627

(51) Int. Cl.

| | |
|---|---|
| ***H01R 25/00*** | (2006.01) |
| ***H01R 13/40*** | (2006.01) |
| ***H01R 24/60*** | (2011.01) |
| ***H01R 9/22*** | (2006.01) |
| *H01R 13/24* | (2006.01) |
| *H01R 13/22* | (2006.01) |
| *H01R 13/52* | (2006.01) |

(52) U.S. Cl.

CPC ..... *H01R 13/40* (2013.01); *H01R 9/223* (2013.01); *H01R 13/2421* (2013.01); *H01R 13/5224* (2013.01); *H01R 24/60* (2013.01); *H01R 13/22* (2013.01); *H01R 13/24* (2013.01); *H01R 13/521* (2013.01); *H01R 2201/12* (2013.01); *Y10S 439/909* (2013.01)

(58) Field of Classification Search

CPC .... H01R 13/22; H01R 13/24; H01R 13/2421; Y10S 439/909

USPC ..... 439/289, 909

See application file for complete search history.

(56) References Cited

U.S. PATENT DOCUMENTS 3,478,297 A * 11/1969 Gimpel ..... H01R 13/523 439/205
5,063,314 A * 11/1991 DeSantis ..... H01R 29/00 310/71
5,924,884 A * 7/1999 Sato ..... H01R 33/9655 439/336
5,954,520 A * 9/1999 Schmidt ..... B60D 1/64 439/289

(Continued)

FOREIGN PATENT DOCUMENTS

DE 198 36 693 A1 2/2000
DE 20 2009 003 592 U1 5/2009

(Continued)

*Primary Examiner* — Tho D Ta

(74) *Attorney, Agent, or Firm* — Baker & Hostetler LLP

(57) ABSTRACT

A medical instrument comprises an interface for electrically connecting a drive unit with the medical instrument. The interface has a plurality of electrical contacts arranged in a connecting surface. At least one of the contacts in the connecting surface is electrically isolated from the remaining contacts by a recess or an elevation.

16 Claims, 7 Drawing Sheets

(56) References Cited

U.S. PATENT DOCUMENTS

| | | | | |
|---|---|---|---|---|
| 6,113,407 | A * | 9/2000 | Martin | H01R 13/521 439/205 |
| 6,338,657 | B1 | 1/2002 | Harper et al. | |
| 6,542,577 | B1 | 4/2003 | Kaczmarek et al. | |
| 6,575,764 | B1 * | 6/2003 | Reipur | H01R 13/24 439/289 |
| 6,592,409 | B1 * | 7/2003 | Oehme | H01R 13/52 439/680 |
| 6,746,284 | B1 * | 6/2004 | Spink, Jr. | H01R 13/115 439/651 |
| 7,604,505 | B2 * | 10/2009 | Zayas | H01J 5/54 439/236 |
| 8,382,790 | B2 * | 2/2013 | Uenohara | A61B 17/29 606/205 |
| 2012/0028489 | A1 | 2/2012 | Gramsamer et al. | |
| 2013/0065443 | A1 | 3/2013 | Jullien et al. | |
| 2014/0121680 | A1 * | 5/2014 | Uchida | A61B 17/0469 606/144 |
| 2015/0110444 | A1 | 4/2015 | Tanaka et al. | |
| 2016/0015409 | A1 * | 1/2016 | Sakaguchi | A61B 17/29 606/34 |

FOREIGN PATENT DOCUMENTS

| | | | |
|---|---|---|---|
| JP | 2013-502949 | A | 1/2013 |
| WO | 2009/009827 | A1 | 1/2009 |
| WO | 2014/162495 | A1 | 10/2014 |

* cited by examiner

MEDICAL INSTRUMENT AND DRIVE UNIT EACH HAVING AN INTERFACE FOR ELECTRICALLY CONNECTING THE DRIVE UNIT WITH THE MEDICAL INSTRUMENT

CROSS-REFERENCE TO RELATED APPLICATION

This application claims priority to foreign German patent application No. DE 102015111627.8, filed on Jul. 17, 2015, the disclosures of which are incorporated by reference in their entirety.

FIELD OF THE INVENTION

The invention relates to medical instrument having an interface for electrically connecting a drive unit with the medical instrument, and to a drive unit having an interface for electrically connecting the drive unit with a medical instrument.

BACKGROUND

It is known from the prior art to operate medical instruments such as laparoscopic instruments by a drive unit that can be separated from the medical instrument. By means of this, it is possible to operate different instruments after each other with one and the same drive unit, whereby costs can be saved when manufacturing the instruments. Furthermore, in this manner the medical instruments can be exchanged while the drive unit can have a longer life span and is preserved.

The prior art reveals for instance reference WO 2014/162495 A1 which shows such an instrument including a drive unit. For the electrical connection between the drive unit and the medical instrument, contact pins which are provided either at the drive unit or the medical instrument are inserted between spring contacts that are provided at the respective other one of medical instrument and drive unit. By means of the returning forces of the spring contacts, the contact pins are retained.

What is problematic in doing so is, on the one hand, an increased expenditure of force in the connection between drive unit and medical instrument. Moreover, the contact points are difficult to clean. In particular due to the residual moisture, there is a high risk of an electrical short circuit, whereby an operation of the instrument in the intended manner is not possible.

Hence, there is need for providing a medical instrument having an intersection for electrically connecting a drive unit with the medical instrument, said intersection enabling a simple connection of the medical instrument and the drive unit as well as an easy cleaning of contact points in the area of the interface.

SUMMARY OF THE INVENTION

A medical instrument according to the invention comprises an interface for electrically connecting a drive unit with the medical instrument which contains a plurality of electrical contacts that are arranged in a connecting surface. At least one of the contacts in the connecting surface is electrically isolated from the remaining contacts by means of a recess provided in the connecting surface or an elevation provided in the connecting surface.

By means of the electrical isolation of the at least one contact from the remaining contacts, an electrical short circuit between the one contact and the remaining contacts can very likely be ruled out in case of residual moisture occurring at the connecting surface. The same advantageous effect occurs if a liquid such as blood coats the connecting surface in the course of working with the medical instrument.

Advantageously, the connecting surface, except for the recess or the elevation, is formed planar.

This design enables simple drain off liquids possibly adhering to the connecting surface during use of the medical instrument or during cleaning. Furthermore, a cleaning/sterilization process is facilitated.

Advantageously, the recess or elevation can be designed in the shape of a notch or a step.

This kind of design enables a simple manufacturing. Moreover, it is easy to design the recess or the elevation to a counterpart in an accurately fitting manner.

The connecting surface can advantageously have a substantially rectangular shape. The recess or the elevation may substantially be arranged in a rectangular manner with respect to the longitudinal sides of the rectangle constituting the connecting surface.

With this kind of design, there is sufficient space for arranging the contacts that are not electrically isolated from each other.

Advantageously, the recess or the elevation serves as a liquid barrier.

This is beneficial particularly if there is still some residual moisture at the connecting surface from a preceding sterilization process or if a liquid such as blood coats the connecting surface in the course of working with the instrument.

The recess or the elevation can extend from an edge of the connecting surface to an opposite edge of the connecting surface. Furthermore, the recess or the elevation can be arranged in the connecting surface in an eccentric manner.

By means of this, it is ensured with utmost certainty that the electrical isolation of the at least one contact from the other contacts can be maintained also then, whereby an electrical short circuit can be avoided if a larger amount of liquid coats the connecting surface.

Advantageously, the interface can also include a counter surface having electrical counter contacts. The arrangement of the counter contacts of the counter surface corresponds to a mirrored arrangement of the contacts of the connecting surface.

By means of this, an electrical connection between the counter contacts of the counter surface and the contacts of the connecting surface is advantageously possible by bringing the two surfaces into abutment.

Advantageously, one of the counter contacts in the counter surface is electrically isolated from the remaining contacts by means of an elevation that is provided in the counter surface or a recess that is provided in the counter surface.

As in the case of the connecting surface, an electrical short circuit between the one counter contact and the remaining counter contacts can very likely be ruled out here due to the elevation that is provided in the counter surface or the recess that is provided in the counter surface in case residual moisture occurs at the counter surface. The same advantageous effect occurs if a liquid such as blood coats the connecting surface in the course of working with the medical instrument.

In an advantageous manner, the elevation or the recess of the counter surface can be connected in a form-fitting manner with the recess or the elevation of the connecting surface. By means of this, the contacts of the counter surface get into abutment in an electrically conducting manner with the respective contacts of the connecting surface.

The elevation that is provided in the counter surface or the recess that is provided in the counter surface is connected (gets into abutment) in a form-fitting manner with the recess that is provided in the connecting surface or the elevation that is provided in the connecting surface. In a case where there is a liquid that coats the connecting surface or the counter surface, it is ensured by means thereof that a distribution of the liquid due to a possible capillary effect between the connecting surface and the counter surface is reliably interrupted.

Advantageously, the number of the contacts of the connecting surface and the number of the counter contacts of the counter surface can amount to four, respectively. Three of the contacts/counter contacts can be electrically isolated from the remaining one contact/counter contact by the elevation or the recess.

Hence, it is possible to provide three different functions by means of the three contacts/counter contacts while the one electrically isolated contact/counter contact is grounded.

Advantageously, the three contacts that are isolated from the one contact by the elevation or the recess are arranged in the shape of an isosceles triangle.

This arrangement of the contacts in the connecting surface or of the counter contacts in the counter surface enables a distinct allocation of the individual functions to the respective contacts. By means thereof, an incorrect connection in the course of the manufacturing process can be avoided which substantially reduces the accruement of waste.

Advantageously, the contacts are designed as resilient contacts or as rigid contacts having a convex surface.

If the contacts are designed as resilient contacts in one of the two surfaces, they are shifted due to bringing them into abutment with the rigid contacts of the respective other surface. Thus, a secure electrical connection of all contacts can be enabled which might otherwise be endangered due to dimensional tolerance, etc. By means of the design of the rigid contacts with a convex surface, it is additionally ensured that possibly existing liquid can drain from the surface thereof in a comparatively fast manner, whereby the function of the interface is ensured.

In a particularly advantageous manner, the resilient contacts can be provided with a seal in the area of the connecting surface or the counter surface.

By means of the seal, it is ensured that an entry of liquid into the interior of the contacts or even the medical instrument or the drive unit is ruled out even if the resilient contacts are shifted due to the connection with rigid contacts.

Advantageously, the connecting surface can form part of a medical instrument or part of a drive unit.

Advantageously, the counter surface can form part of a medical instrument or part of a drive unit.

The connecting surface or the counter surface or both are advantageously made of a material that is not electrically conducting such as plastic. Advantageously, the recess or the elevation can both be made of the same non-conducting material.

The medical instrument can have a housing that includes a coupling connection for coupling with an output shaft of a drive unit and a connecting surface having a plurality of electrical contacts that are arranged in the connecting surface. At least one of the contacts in the connecting surface is electrically isolated from the remaining contacts by means of a recess in the shape of a notch extending through the entire connecting surface or by an elevation in the shape of a notch extending through the entire connecting surface or by an elevation in the shape of a step extending through the entire connecting surface.

Advantageously, the contacts can be designed as resilient contacts which are shifted into the housing in case of getting into abutment with counter contacts of a counter surface. The contacts can also be provided with a seal in the area of the connecting surface, whereby an entry of liquid into the housing is prevented.

Advantageously, the number of the contacts can be four, and three of the contacts can be electrically isolated from the remaining one contact by the notch or the step. The three contacts can advantageously be arranged in the shape of an isosceles triangle.

The medical instrument may be a surgical instrument, preferably a laparoscopic instrument. Examples for such instruments are a needle holder, a bipolar forceps, a bipolar scissors.

The invention also relates to a drive unit having a housing and an output shaft that protrudes from the housing. The housing also includes a connecting surface having a plurality of electrical contacts that are arranged in the counter surface. Preferably, at least one of the contacts in the connecting surface is isolated from the remaining contacts by means of a recess in the shape of a notch extending through the entire counter surface or by an elevation in the shape of a step extending through the entire counter surface. The connecting surface is provided to be brought into abutment with the connecting surface of the medical instrument described above. Thereby, one of the two connecting surfaces meets the function of a counter surface and, thus, one of the connecting surfaces of either the medical instrument or the drive unit may be also referred to as "counter surface" in the following description and the claims. In particular, this terminology will be used to distinguish the two connecting surfaces when they are mentioned together.

Due to the electrical isolation of the at least one contact from the remaining contacts at the connecting surface or the counter surface by means of the notch or the step, it is possible that a short circuit and thus an accidental start of a motor provided in the drive unit are prevented if moisture enters. Preferably, the contacts are aligned flatly with the connecting surface or the counter surface, respectively. Thus, the cleaning of the surfaces is facilitated. The surfaces of the contacts may be designed in a convex manner whereby it is prevented that moisture remains on the contact surface.

Further advantages of the invention will be recognized by means of the present detailed description of a currently preferred design in connection with the attached Figures.

DETAILED DESCRIPTION

In the following, a currently preferred embodiment of the invention will be described by means of FIGS. 1 to 7.

Figure 1:
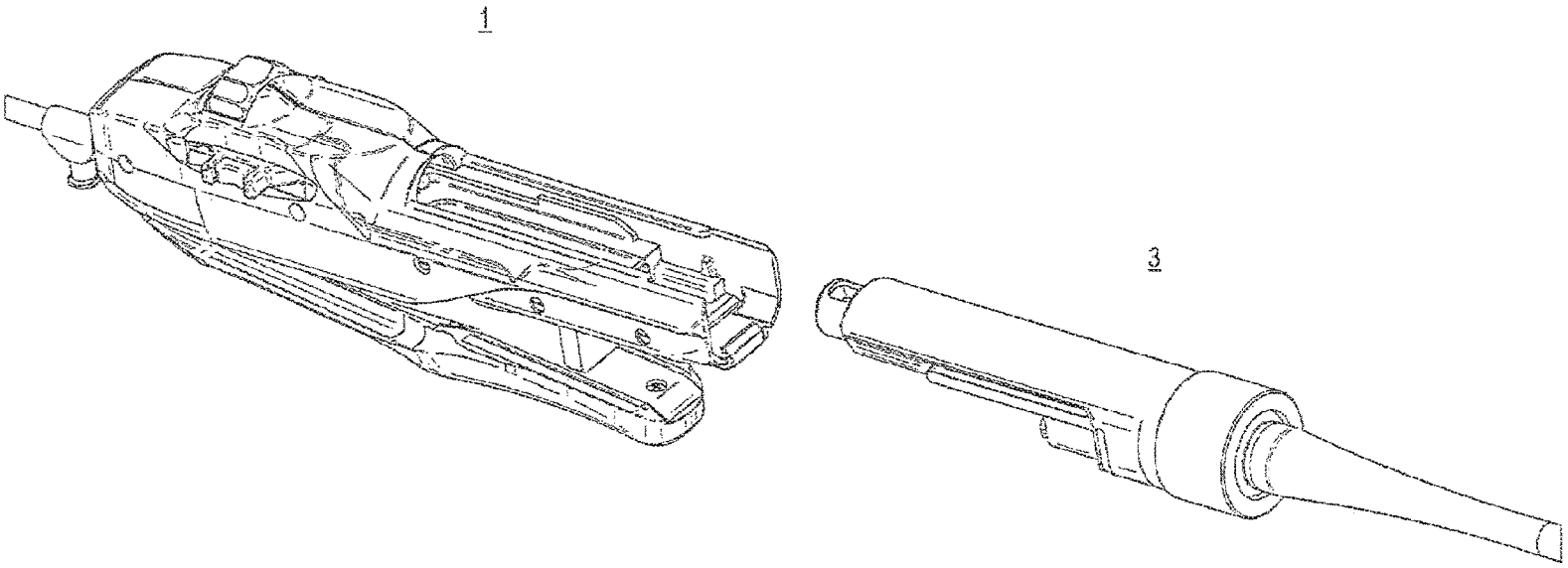
FIG. 1 shows a perspective view of a medical instrument and a drive unit in a state separated from each other.
Figure 2:
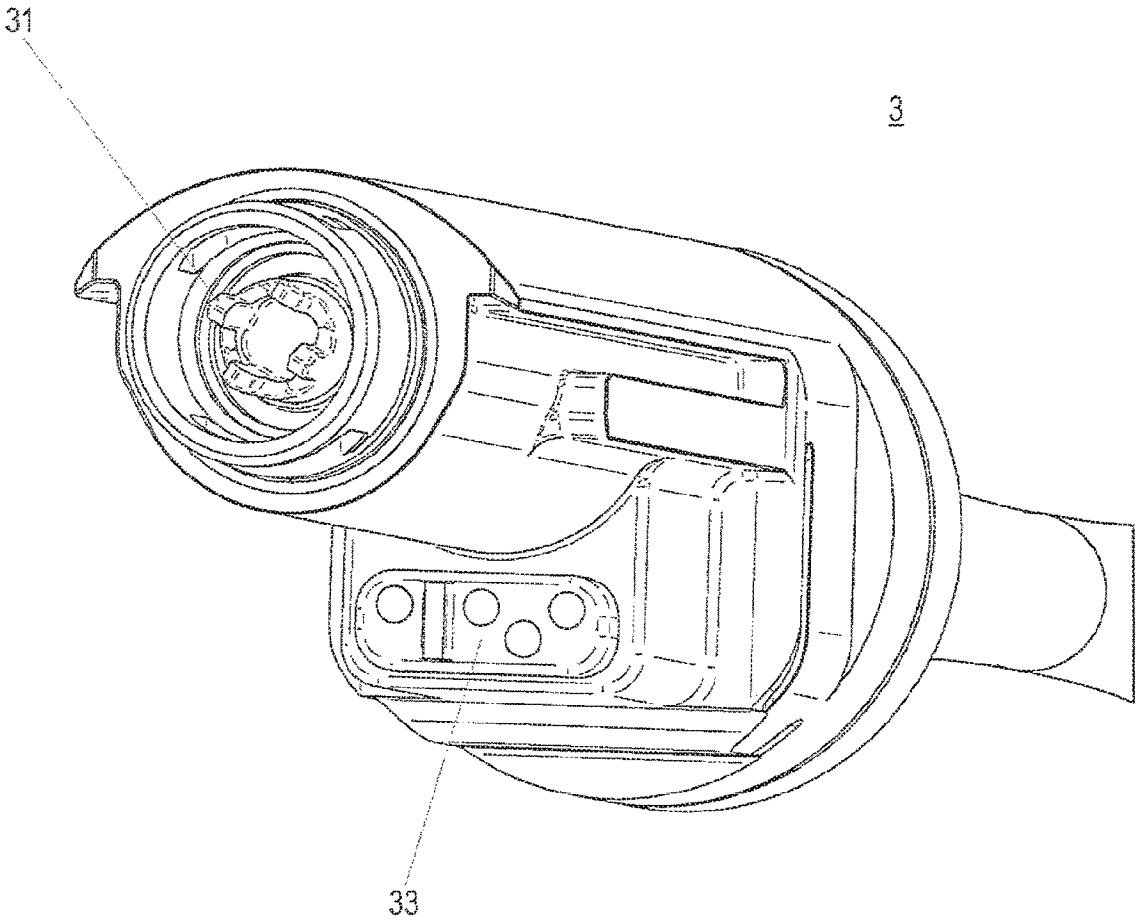
FIG. 2 shows a perspective view of the drive unit with a view to a counter surface.

FIG. 1 shows a medical instrument 1 and a drive unit 3 in a state separated from each other. The drive unit 3 is provided to be inserted in a guide support 17, obvious from FIG. 4, of the medical instrument 1, whereby an output shaft 31, obvious from FIG. 2, of the drive unit 3 is engaged with a coupling 13 that is provided in the medical instrument 1. For the electrical connection, a connecting surface 11 is provided in a socket at the medical instrument 1. In the substantially rectangular connecting surface 11, four contacts 111*a*, 111*b*, 111*c* and 113 are arranged. Contact 113 is electrically isolated from the remaining contacts 111*a*, 111*b*, 111*c* by a notch (recess) 115. The connecting surface is formed planar.

The contacts 111*a*, 111*b*, 111*c*, 113 are designed as resilient contacts. As is evident from FIG. 7, the resilient contacts 111*a*, 111*b*, 111*c*, 113 have an outer sleeve 117 in which a contact pin 114 is mounted in an axially shiftable manner. Between the outer sleeve 117 and the contact pin 114, a seal in the shape of a seal ring 119 is provided that is arranged in mounting position in the area of the connecting surface 11. A seal ball 116 made of stainless steel which is arranged in the lower area of the resilient contact 111*a*, 111*b*, 111*c*, 113 arranges for a seal to the interior of the housing of the medical instrument 1.

A spring 118 (in FIG. 7, merely the bottom-most end of the spring 118 is visible), that is arranged in the outer sleeve 117 is preloaded when connecting the medical instrument 1 with the drive unit 3 as the contact pin 114 is shifted downwards relatively to the outer sleeve 117 and thus preloads the spring. If the drive unit 3 and the medical instrument 1 are separated from each other again, the spring 118 serves the return of the contact pin 114.

Figure 3:
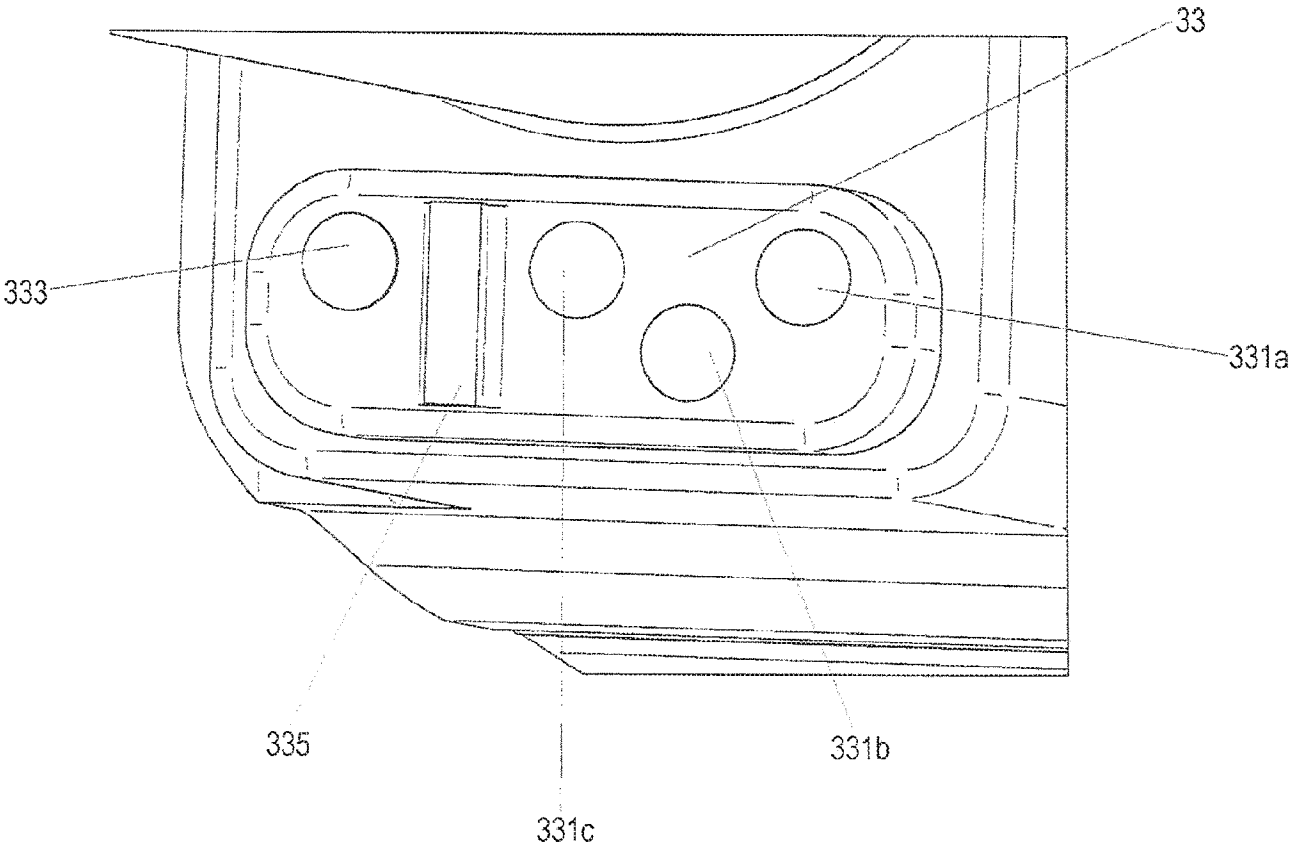
FIG. 3 shows a detailed view of the counter surface with counter contacts as part of the drive unit.
Figure 4:
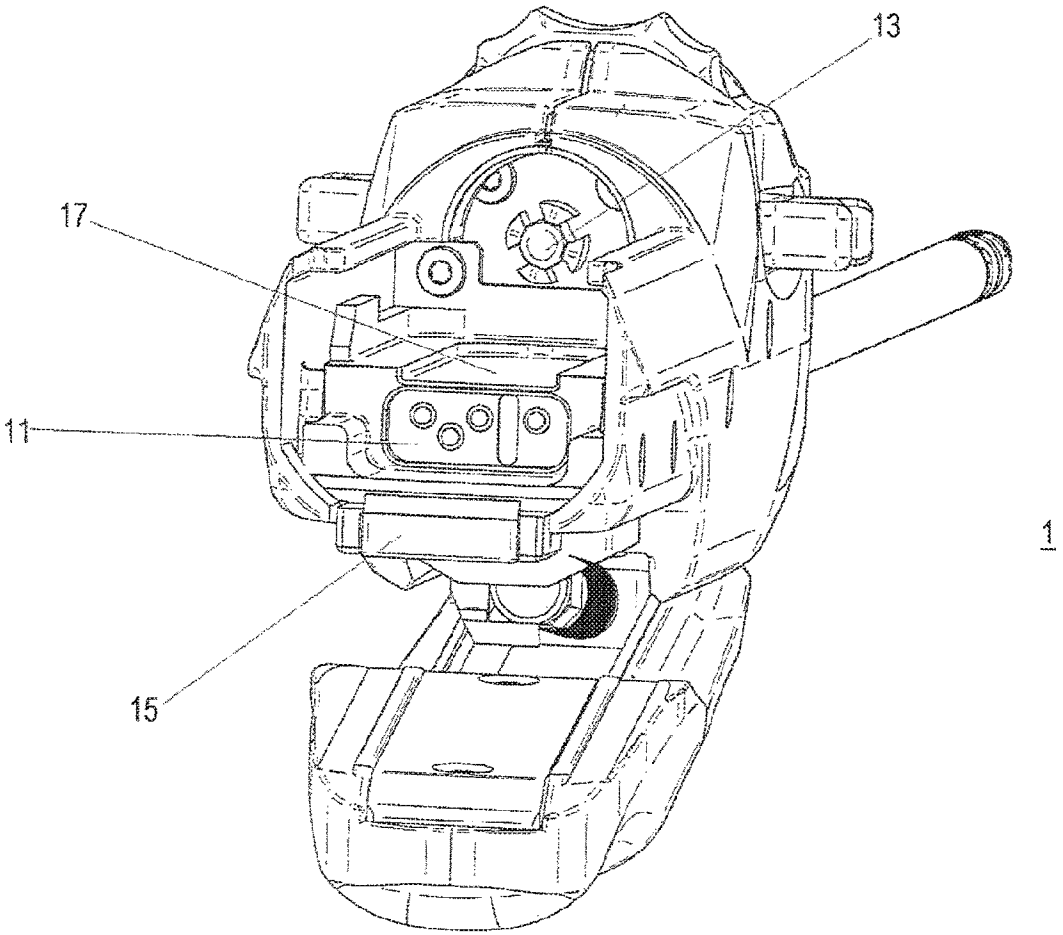
FIG. 4 shows a perspective view of the medical instrument with a view to a connecting surface.

FIG. 3, in detail, shows a connecting surface which is referred to as a counter surface 33 in the following to distinguish the same from the connecting surface 11 provided at the medical instrument 1. The counter surface 33 is provided with counter contacts 331*a*, 331*b*, 331*c* and 333, said counter surface 33 being provided at the drive unit. The counter contact 333 is electrically isolated from the remaining contacts 331*a*, 331*b*, 331*c* by means of a stepped land (elevation) 335.

Figure 6:
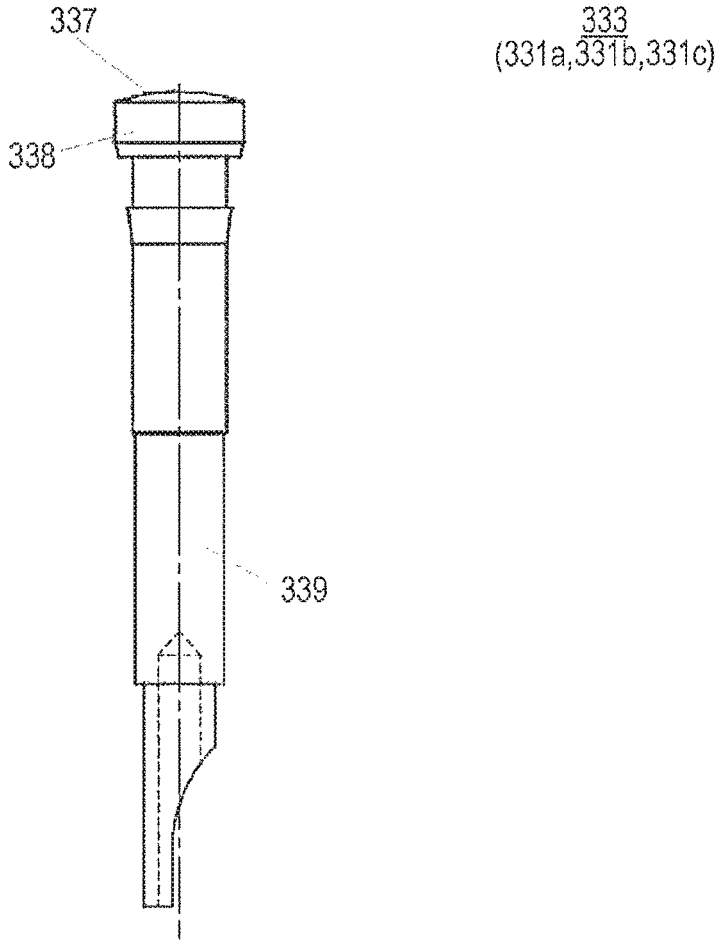
FIG. 6 shows a view of a rigid contact.
Figure 7:
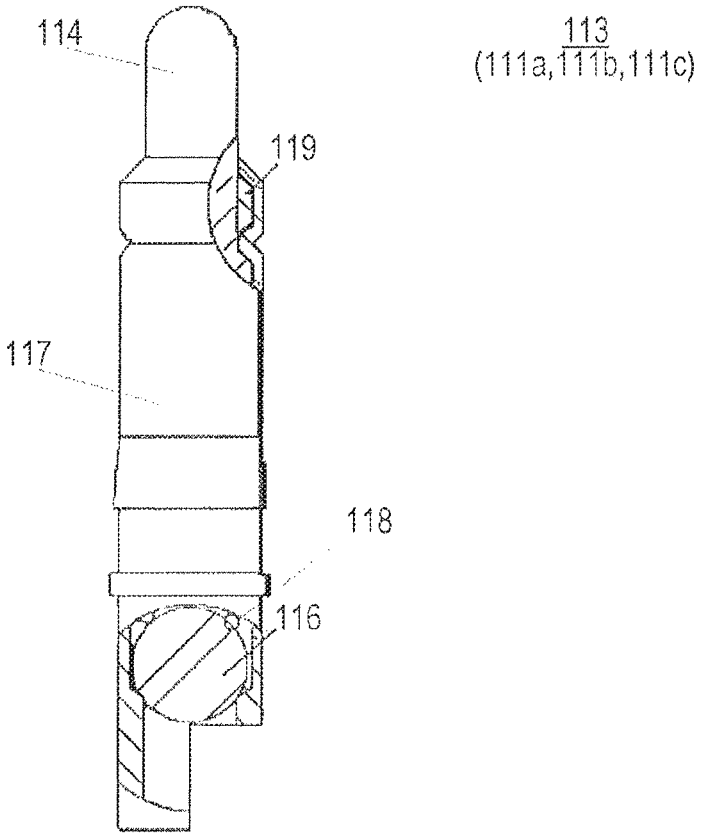
FIG. 7 shows a partially sectioned view of one of the resilient contacts.

The counter contacts 331*a*, 331*b*, 331*c* and 333, which are shown in detail in FIG. 6, are designed as rigid contacts (counter contacts) and have a head 338 having a convex surface 337 and a body 339. Due to the land 335 and the convex surface 337 of the rigid counter contacts 331*a*, 331*b*, 331*c*, 333, it can very likely be avoided that a short circuit occurs in the area of the counter surface/connecting surface due to existing liquid, and there is hence an unintended activation of the motor provided in the drive unit 3 during operation of the medical instrument.

Namely, the land 335 serves as liquid barrier. Moreover, it is substantially facilitated due to the convex surface 337 of the counter contacts 331*a*, 331*b*, 331*c*, 333, which are arranged in the area of the counter surface, that liquid existing in the area of the counter contact surface 33 drains from the counter contacts 331*a*, 331*b*, 331*c*, 333. Due to this reason, a short circuit can be ruled out with the utmost certainty even in a case in which there is an entry of liquid such as blood into the area of the interface between the connecting surface 11 and the counter surface 33 during operation of the drive unit with a medical instrument.

If the drive unit 3 is connected with the medical instrument 1, the counter contacts 331, 333 are brought into abutment with the contact pins 114 of the resilient contacts 111, 113. By means of a final connection of the drive unit 3 and the medical instrument 1, the counter contacts 331*a*, 331*b*, 331*c*, 333 press on the contact pins 114 of the contacts 111, 113, whereby the contact pins 114 are axially shifted inside the outer sleeve 117. By means of this, the spring 118 that is provided inside of the outer sleeve 117 is preloaded.

Hence, due to the preloading of the spring 118, an electrical connection between the individual contacts 111, 113 and the respective counter contacts 331*a*, 331*b*, 331*c*, 333 is ensured.

Moreover, the stepped land 335 is brought into abutment with the notch 115 in a form-fitting manner. Due to this connection, it can be ruled out with the utmost certainty that a short circuit occurs during the operation of the medical instrument 1 with the drive unit 3 due to liquid entered between the connecting surface 11 and the counter surface 33, said liquid being distributed between the connecting surface and the counter surface due to a capillary effect, and thus an unintended activation of the motor of the drive unit 3 occurs.

Figure 5:
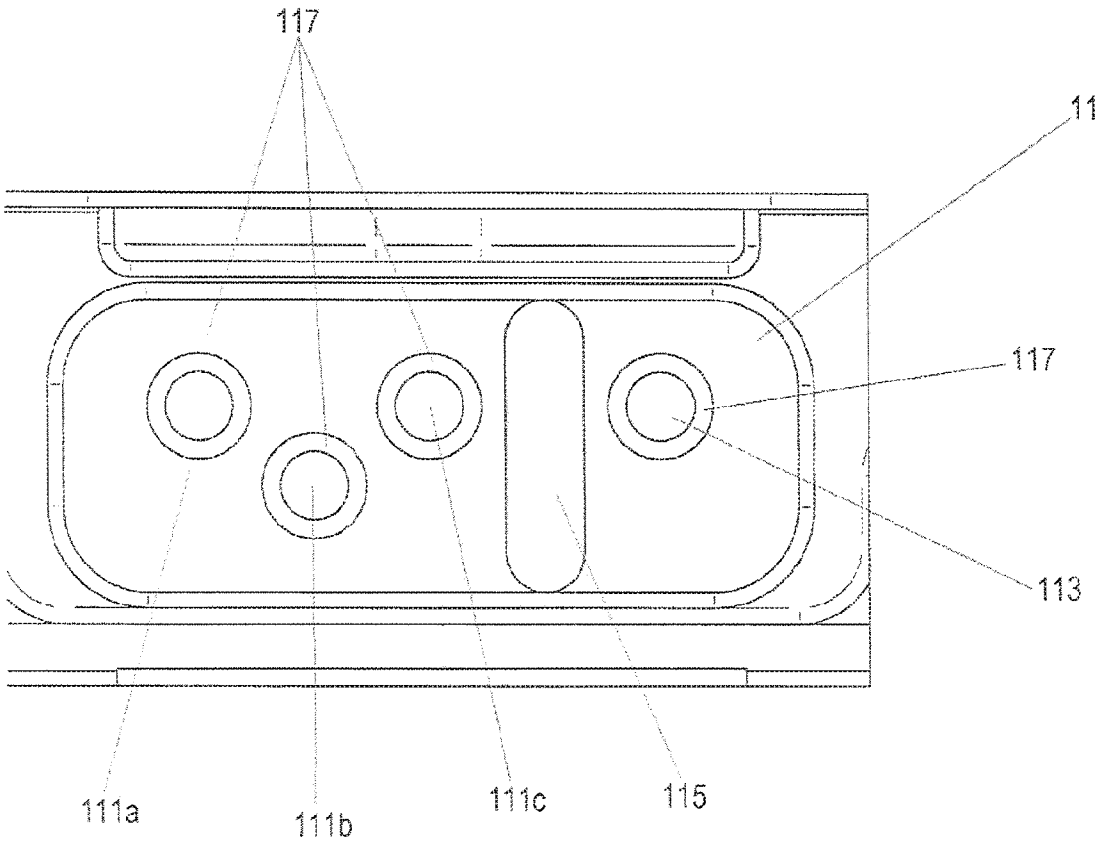
FIG. 5 shows a detailed view of the connecting surface with contacts as part of the medical instrument.

As can be seen from FIG. 5, the notch 115 is arranged between the longitudinal edges of the connecting surface 11 and electrically isolates the contact 113 from the remaining contacts 111*a*, 111*b*, 111*c* . By means of this, it is reliably prevented that the liquid existing at the connecting surface 11 produces a conducting connection between the contact 113 and the contacts 111*a*, 111*b*, 111*c* that are electrically isolated from the latter.

In the same manner, it can be seen from FIG. 3 that the land 335 which is provided laterally inversed to the notch 15 prevents a conducting connection between the counter contact 333 and the remaining counter contacts 331*a*, 331*b*, 331*c*, said conducting connection being caused by liquid at the counter surface 33.

Liquids may for instance be blood or remains of sterilization liquid which get into contact with the medical instrument during working with the medical instrument or in the course of a preceding sterilization process.

In order to maintain the connected state of the drive unit 3 with the medical instrument 1 during working, an additional mechanical interlock 15 is provided which prevents an unintended release of the drive unit 3 from the medical instrument 1 and thus a separation of the connecting surface 11 from the counter surface 33 with the contacts 111*a*, 111*b*, 111*c*, 113 or the counter contacts 331*a*, 331*b*, 331*c*, 333, respectively.

In the following, an exemplary assignment of the contacts is described. The contact 113 or 333, respectively, serves the transmission of a ground signal. The contacts 111*b*, 111*c* or 331*b*, 331*c*, respectively, serve the transmission of a clockwise rotation signal or a counter-clockwise rotation signal for the motor in the drive unit. The contact 111*a* or 331*a*, respectively, serves the transmission of a so-called "1-wire" signal. This can be used for instance for communication with a control unit, for instrument detection or for cycle counting (how often the medical instrument has been in use already).

The medical instrument 1 is preferably designed as an instrument for laparoscopic surgery such as a bipolar forceps as a needle holder or as a bipolar scissors which is inserted into an abdomen of a patient by means of a trocar. Due to the resilient contacts 111*a*, 111*b*, 111*c*, 113 in the connecting surface 11 of the medical instrument 1, both the resilient contacts 111*a*, 111*b*, 111*c*, 113 and the counter contacts 331*a*, 331*b*, 331*c*, 333 can be designed in a very flat manner, whereby cleaning is substantially facilitated.

As can be seen particularly from FIGS. 3 and 5, according to the currently preferred embodiment, the contacts 111*a*, 111*b*, 111*c* and the counter contacts 331*a*, 331*b*, 331*c* which are not provided for the transmission of a ground signal are arranged in the shape of an isosceles triangle. All in all, the contacts 111*a*, 111*b*, 111*c*, 113 and the counter contacts 331*a*, 331*b*, 331*c*, 333 are arranged asymmetrically in the connecting surface 11 or the counter surface 33.

The notch 115 is arranged in the connecting surface 11 in an eccentric manner such that the amount of the connecting surface with the contact 113 provided for transmission of a ground signal amounts to roughly one third of the entire surface of the connecting surface 11. In a laterally reversed manner, the land 335 is arranged in the counter surface 33 in an eccentric manner such that the amount of the counter surface 33 with the counter contact 333 provided for transmission of a ground signal amounts to roughly one third of the entire surface of the counter surface 33.

The connecting surface 11 and the counter surface 33 substantially consist of the same material as the housing of the medical instrument 1, or the housing of the drive unit 3, respectively. As material, preferably a non-electrically conducting plastic is used.

It shall be pointed out that the embodiment described above is merely one exemplary possibility for designing the invention and that the invention is not limited by this description. For example, it is possible that a step be provided in the connecting surface of the medical instrument 1 instead of a notch, and that a notch be provided in the counter surface of the drive unit 3. The function of the interface is possible in a satisfactory manner also if the stepped elevation is completely removed.

Experts will recognize that the design is possible in the most various manners which are defined by the scope of the pending claims.

The invention claimed is:

1. A medical instrument comprising:

an interface for electrically connecting a drive unit with the medical instrument, the interface having a plurality of electrical contacts arranged in a connecting surface, wherein at least one of the contacts in the connecting surface is electrically isolated from the remaining contacts by means of one single recess that is provided in the connecting surface or one single elevation that is provided in the connecting surface, and wherein the recess or the elevation extends from an edge of the connecting surface to an opposite edge of the connecting surface, and the recess or the elevation is arranged in an eccentric manner.

2. The medical instrument according to claim 1, wherein the connecting surface, except for the recess or the elevation, is formed planar.

3. The medical instrument according to claim 1, wherein the recess or the elevation is designed in the shape of a notch or a step.

4. The medical instrument according to claim 1, wherein the connecting surface has a substantially rectangular shape, and wherein the recess or the elevation is arranged substantially rectangular with respect to the longitudinal sides of the rectangle.

5. The medical instrument according to claim 1, wherein the recess or the elevation serves as liquid barrier.

6. The medical instrument according to claim 1, further comprising a housing which has a coupling connection for coupling with an output shaft of a drive unit.

7. The medical instrument according to claim 1, wherein the medical instrument is connectable via the connecting surface with a counter surface of a drive unit, the counter surface having electrical counter contacts, and wherein the arrangement of the counter contacts of the counter surface corresponds to a mirrored arrangement of the contacts of the connecting surface.

8. The medical instrument according to claim 7, wherein at least one of the counter contacts in the counter surface is electrically isolated from the remaining counter contacts by means of one single elevation provided in the counter surface or one single recess provided in the counter surface.

9. The medical instrument according to claim 8, wherein the elevation or the recess of the counter surface is adapted to be brought into connection in a form-fitting manner with the recess or the elevation of the connecting surface, whereby the counter contacts of the counter surface get into abutment with the respective contacts of the connecting surface in an electrically-conducting manner.

10. The medical instrument according to claim 9, wherein the number of the contacts of the connecting surface and the number of the counter contacts of the counter surface amounts to four, respectively, and three of the contacts or counter contacts are electrically isolated from the remaining one contact or counter contact by the recess or the elevation.

11. The medical instrument according to claim 10, wherein the three contacts that are isolated from the remaining contact and the three counter contacts that are isolated from the remaining counter contact are arranged in the shape of an isosceles triangle.

12. The medical instrument according to claim 7, wherein the contacts and the counter contacts are designed as resilient contacts or as rigid contacts having a convex surface.

13. The medical instrument according to claim 12, wherein the resilient contacts are each provided with a seal in the area of the connecting surface or the counter surface.

14. A drive unit comprising:

a housing;

an output shaft protruding from the housing and configured to be coupled with a coupling connection of a medical instrument; and an interface for electrically connecting the drive unit with the medical instrument, the interface having:

a plurality of electrical contacts arranged in a connecting surface, wherein at least one of the contacts in the connecting surface is electrically isolated from the remaining contacts by means of one single elevation that is provided in the connecting surface or one single recess that is provided in the connecting surface, wherein the recess or the elevation extends from an edge of the connecting surface to an opposite edge of the connecting surface, and the recess or the elevation is arranged in an eccentric manner.

15. The drive unit according to claim 14, wherein the connecting surface, except for the elevation or the recess, is formed planar.

16. A medical instrument comprising:

an interface for electrically connecting a drive unit with the medical instrument, the interface having a plurality of electrical contacts arranged in a connecting surface, wherein at least one of the contacts in the connecting surface is electrically isolated from the remaining contacts by means of a recess that is provided in the connecting surface or an elevation that is provided in the connecting surface, wherein the medical instrument is connectable via the connecting surface with a counter surface of a drive unit, the counter surface having electrical counter contacts, wherein the arrangement of the counter contacts of the counter surface corresponds to a mirrored arrangement of the contacts of the connecting surface, wherein at least one of the counter contacts in the counter surface is electrically isolated from the remaining counter contacts by means of an elevation provided in the counter surface or a recess provided in the counter surface, and wherein the elevation or the recess of the counter surface is adapted to be brought into connection in a form-fitting manner with the recess or the elevation of the connecting surface, whereby the counter contacts of the counter surface get into abutment with the respective contacts of the connecting surface in an electrically-conducting manner.

* * * * *